US006662792B2

(12) United States Patent
Dutt et al.

(10) Patent No.: US 6,662,792 B2
(45) Date of Patent: Dec. 16, 2003

(54) CAPACITOR DISCHARGE IGNITION (CDI) SYSTEM

(75) Inventors: Saibal Dutt, New Delhi (IN); Nabarun Dasgupta, Nodia (IN); Nikhil Kulshrestha, Nodia (IN)

(73) Assignee: STMicroelectronics Pvt. Ltd., Uttar Pradesh (IN)

( * ) Notice: Subject to any disclaimer, the term of this patent is extended or adjusted under 35 U.S.C. 154(b) by 0 days.

(21) Appl. No.: 10/256,216

(22) Filed: Sep. 26, 2002

(65) Prior Publication Data

US 2003/0056773 A1 Mar. 27, 2003

(30) Foreign Application Priority Data

Sep. 27, 2001 (IN) ..... 991/2001

(51) Int. Cl.[7] ..... F02P 3/08
(52) U.S. Cl. ..... 123/598; 123/599; 123/651
(58) Field of Search ..... 123/406.57, 598, 123/599, 649, 651

(56) References Cited

U.S. PATENT DOCUMENTS

| | | | | |
|---|---|---|---|---|
| 3,340,861 A | | 9/1967 | Schiff | 123/148 |
| 3,620,201 A | | 11/1971 | Warren et al. | 123/148 E |
| 3,658,044 A | | 4/1972 | Safstrom | 128/148 E |
| 3,838,328 A | | 9/1974 | Lundy | 321/2 |
| 4,115,758 A | * | 9/1978 | Luteran | 123/651 |
| 4,155,340 A | * | 5/1979 | Fernquist et al. | 123/651 |
| 4,228,778 A | | 10/1980 | Rabus et al. | 123/605 |
| 4,738,239 A | | 4/1988 | Haines et al. | 123/651 |
| 4,922,883 A | | 5/1990 | Iwasaki | 123/598 |
| 4,993,396 A | * | 2/1991 | Miura | 123/651 |
| 5,220,901 A | | 6/1993 | Morita et al. | 123/604 |
| 5,634,453 A | * | 6/1997 | Taruya et al. | 123/651 |
| 6,425,383 B1 | * | 7/2002 | Raeske et al. | 123/651 |

* cited by examiner

*Primary Examiner*—Erick Solis
(74) *Attorney, Agent, or Firm*—Lisa K. Jorgenson; Allen, Dyer, Doppelt, Milbrath & Gilchrist, P.A.

(57) ABSTRACT

A capacitor discharge ignition (CDI) system is capable of generating intense continuous electrical discharge at a spark gap for a desired duration and may include a second controllable power switching circuit with its input terminal connected to an output terminal of a high voltage DC source device. An output terminal of the second controllable power switching circuit is connected to an input terminal of a first power switching circuit. The second controllable power switching circuit may also have a control terminal connected to an output of a controller. The first controllable power switching circuit may be used for discharging a discharge capacitor, and the second controllable power switching circuit may cause charging of the discharge capacitor. As such, an ignition current through an ignition coil of the system is enabled for any desired number of cycles during both the charge and discharge cycles of the discharge capacitor.

39 Claims, 9 Drawing Sheets

CAPACITOR DISCHARGE IGNITION (CDI) SYSTEM

FIELD OF THE INVENTION

The present invention is directed to the field of ignition systems, and, more particularly, to a capacitor discharge ignition (CDI) system capable of producing continuous ignition sparks of various durations.

BACKGROUND OF THE INVENTION

Automotive ignition systems produce high voltage electrical discharges at the terminals of one or more spark plugs to ignite a compressed air fuel mixture. The electrical discharge is required to be produced when the piston is at a particular physical position inside the cylinder. The spark intensity should also be independent of the engine speed. Further, to optimize engine performance, improve fuel economy, and minimize polluting effluents, the time of occurrence and duration of the spark should be controllable in accordance with a predefined discharge profile.

There are primarily two types of ignition systems in use today, namely inductive ignition systems and capacitive discharge ignition (CDI) systems. In the inductive ignition system, the ignition voltage is generated by a sudden injection of current through the primary winding of the ignition coil. The main disadvantage of the inductive ignition system is that the ignition energy falls off at high engine speed.

In CDI systems, the ignition voltage is generated by discharging a charged capacitor through the primary ignition coil using an electronic switch. The capacitor is initially charged to a high voltage from a high voltage direct current (DC) source. At present, the CDI system is primarily used in two-wheeled vehicles to meet new emission standards and to offer improved fuel economy. Some variations of CDI systems are also used in cars and in certain racing applications.

Modern CDI systems typically use microcontrollers/microprocessors to provide engine parameter dependent ignition timings. To increase spark energy and provide better fuel combustion, some CDI systems also use intermittent multi-spark techniques. Several other improvements have been described in various U.S. patents. For example, U.S. Pat. No. 3,340,861 describes an inductive ignition system in which a ballast resistor is eliminated. However, this system still suffers from the limitations of inductive ignition systems at high engine speed. Moreover, U.S. Pat. Nos. 3,620,201; 3,658,044; and 3,838,328 describe various systems for producing multiple spark ignition in CDI systems. Yet, none of these systems are capable of producing continuous sparks or sparks of an extended duration.

Similarly, U.S. Pat. No. 4,228,778 describes a system for extending the spark duration in CDI systems. Even so, this system is also not capable of relatively long spark duration, as the capacitor needs time for charging between consecutive discharges. U.S. Pat. No. 4,738,239 outlines a system for enabling the use of power MOSFETS in inductive discharge systems, but this system does not offer any improvement in spark duration.

Other examples include U.S. Pat. Nos. 4,922,883 and 5,220,901, which define additional systems for providing multiple sparks and extended sparks in CDI systems, respectively. Even so, these systems are not capable of continuous sparks, nor can discharge time be controlled to achieve extended durations. Additionally, U.S. Pat. No. 6,167,875 provides an approach for adjusting the number of ignitions per cycle per cylinder depending upon the nature of the fuel-air mixture at low and high engine speeds. However, this approach is not capable of enabling continuous sparks of extended duration.

SUMMARY OF THE INVENTION

An object of the present invention is to provide an ignition system that can produce continuous ignition current for durations of various lengths.

This and other objects, features, and advantages in accordance with the present invention are provided by a capacitor discharge ignition (CDI) system capable of generating a continuous electrical discharge at a spark gap for a desired duration. The CDI system may include an ignition capacitor connected at one terminal thereof to a first terminal of the primary side of an ignition coil. At the other terminal, the ignition capacitor may be connected to an input terminal of a first controllable power switching means or circuit. The power switching circuit may also have an output connected to the common terminal of a high voltage DC source means or circuit which generates a stable high DC voltage. The primary side of the ignition coil also may have a second terminal connected to a common (i.e., ground) terminal.

Moreover, the CDI system may also include a controller connected to the control terminal of the first controllable power switching circuit, and a spark gap connected across the secondary side of the ignition coil. In addition, a second controllable power switching means or circuit may also be included with an input terminal connected to the output terminal of the high voltage DC source circuit, an output terminal connected to the input terminal of the first power switching circuit, and a control terminal connected to a second output of the controller. The first controllable power switching circuit may be used for discharging the discharge capacitor, and the second controllable power switching circuit causes charging of the discharge capacitor. This enables an ignition current through the ignition coil for any desired number of cycles during both the charge and discharge cycles of the discharge capacitor.

In particular, the high voltage DC source circuit may be a DC—DC converter that produces a stable high voltage DC output substantially independent of the variation in the voltage from the primary power source. Further, the first controllable power switching circuit and the second controllable power switching circuit may be electronic power switching devices, such as insulated gate bipolar transistors (IGBT), power MOSFETS, and power bipolar junction transistors (BJT). Additionally, the high-voltage DC source may also be an engine alternator.

The controller may be a microcontroller with a half-bridge driver for driving the controllable power switching circuit. The controller may also include a triggering control means or circuit for controlling ignition in accordance with a desired ignition profile. In particular, the triggering control circuit may control ignition in accordance with signals obtained from one or more sensors monitoring various parameters such as piston position, engine speed, throttle position, emission quality, type of fuel, etc.

By way of example, the triggering control circuit may include a data storage device including the triggering profile data, and it may determine desired triggering based on the triggering profile data. Furthermore, the triggering control circuit may include a signal processor for conditioning the signals received from the sensors. The ignition profile may define ignition occurrence and duration values with respect to various piston positions and engine speeds. Preferably, the ignition profile provides larger ignition duration during cold starting and at low speeds to produce fewer pollutants and ensure reliable operation. The CDI system may also therefore advantageously be applied to engines using alternative fuels requiring a long ignition duration.

BRIEF DESCRIPTION OF THE DRAWINGS

The invention will now be described with reference to the accompanying drawings, in which.

DETAILED DESCRIPTION OF THE PREFERRED EMBODIMENTS

Figure 1:
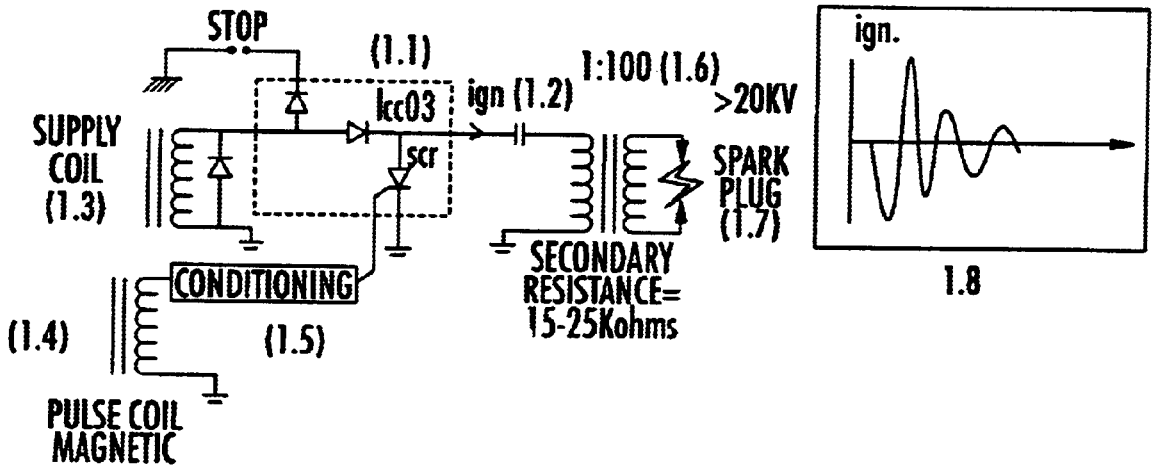
FIG. 1. (PRIOR ART)
FIG. 1 is a schematic circuit diagram of a prior art capacitor discharge ignition (CDI) system.

A typical conventional CDI system is now described with reference to FIG. 1. An application specific device (ASD) 1.1 charges ignition capacitor 1.2 by supplying a rectified high DC voltage thereto, which is generated from the high voltage AC provided by supply coil 1.3. A magnetic pick-up 1.4 monitors piston position and supplies a triggering signal to the ASD 1.1 after suitable signal conditioning by a conditioning circuit 1.5. This triggering signal causes the ASD 1.1 to discharge the ignition capacitor 1.2 through the primary winding of the ignition transformer 1.6 causing an ignition spark across spark plug 1.7 with a typical ignition current profile 1.8.

The ignition transformer 1.6 typically produces a voltage in excess of 10 KV to break down the air gap of the spark plug. The resistance of the air-gap falls to around 50 ohms once the arc strikes. At this point the current is limited only by the impedance of the ignition transformer 1.6, and most of the energy is dissipated in the ignition transformer itself. The angle of advance, which is the position of the piston with respect to top dead center (TDC) (measured in angular degrees) at which the ignition is initiated, is a fixed value irrespective of engine speed.

The signal conditioning circuit 1.5 is used to filter out the effect of EMI and noise from the signal obtained from magnetic pick up 1.4. Typically, the spark duration is a short 100–200 microseconds, and the spark gap current is 20–30 mA. Such an arrangement is generally suitable for a small engine running with a rich fuel-air mixture. The energy stored in the capacitor (i.e., $CV^2/2$) is discharged through the ignition coil by an electronic switch within a very short time. The ignition coil and the capacitor form an LC circuit which produces a damped oscillatory current for a few cycles.

Figure 2:
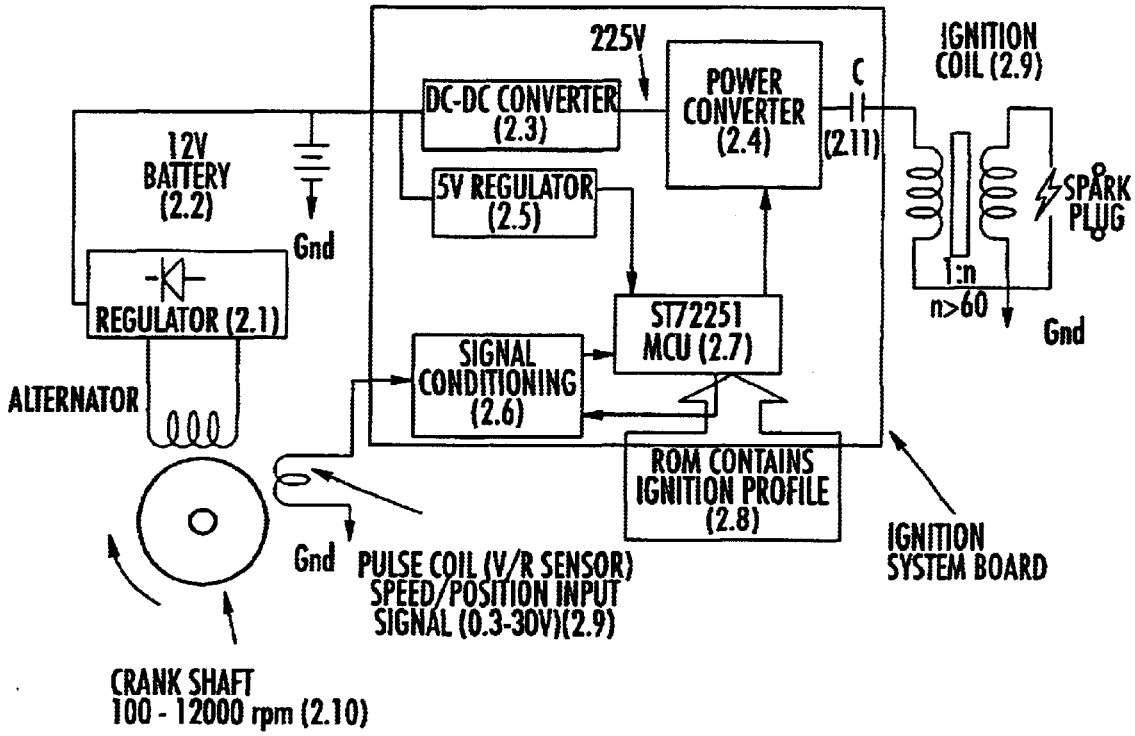
FIG. 2 is a schematic circuit diagram of a CDI system according to the present invention.

One embodiment of a CDI system according to the present invention is illustratively shown in FIG. 2. A DC voltage of 225 V is derived by a DC—DC converter 2.3 from a battery 2.2 (e.g., a 7–12 V battery) which is charged by a regulator supplied by an engine-mounted alternator 2.1. The DC—DC converter 2.3 provides stable voltage irrespective of the speed of the engine, whereas the output voltage from a conventional engine-mounted alternator is typically speed dependant.

The DC voltage is used to supply a power converter 2.4. The voltage supplied by the DC—DC converter is typically in the range of 120–400 V, the actual value being dependent upon the rating of the ignition coil 2.9 that is used. This voltage powers up the power converter 2.4. A microcontroller 2.7 is used to generate the control signal for the power converter. The microcontroller supply is derived from the battery through a low drop regulator 2.5, and the speed signal conditioning circuit 2.6 is directly powered by the battery, preferably with an adequate filter to suppress noise.

A ROM 2.8 stores ignition profile data used by the microcontroller 2.7 to generate signals for controlling the power converter 2.4. This is done in relation to the speed/position signal received from the sensor 2.9 which is mounted on the crankshaft 2.10, after signal conditioning by the signal conditioning circuit 2.6. The power converter 2.4 charges and discharges the ignition capacitor 2.11 through the primary winding of the ignition coil 2.9 under the control of the microcontroller 2.7. The power converter 2.4 is such that ignition current is produced during both the charging and discharging of the ignition capacitor 2.11, resulting in a continuous spark of any desired duration.

Figure 3:
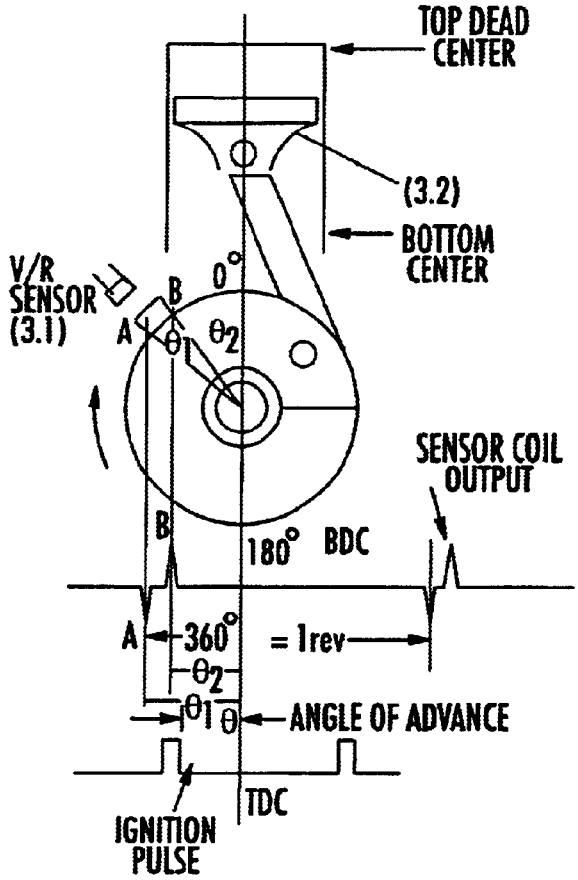
FIG. 3 is a schematic diagram illustrating ignition timings for the system of FIG. 2.

A schematic representation of ignition timing with respect to top dead center of a single cylinder engine is now described with respect to FIG. 3. Positive and negative sinusoidal pulses are obtained at the output of the variable reluctor sensor 3.1 with every revolution of the engine. The width and dimension of the pulses depend on the physical dimension of the sensor. The sensor is generally mounted at 5–10 degrees ahead of top dead center. Apart from speed, the sensor signal also provides the current position of the piston 3.2.

The compressed fuel-air mixture is generally ignited before the piston moves to the top dead center (TDC) to generate maximum thrust just after the piston moves away from TDC. This is generally measured in terms of degrees before TDC, and is commonly referred to as the angle of advance. In modern engine control systems, angle of advance is typically varied with engine speed to ensure complete combustion of fuel, fuel economy, and the production of less pollutants (nitrogen dioxide, hydrocarbons, carbon monoxide, etc.).

Figure 3A:
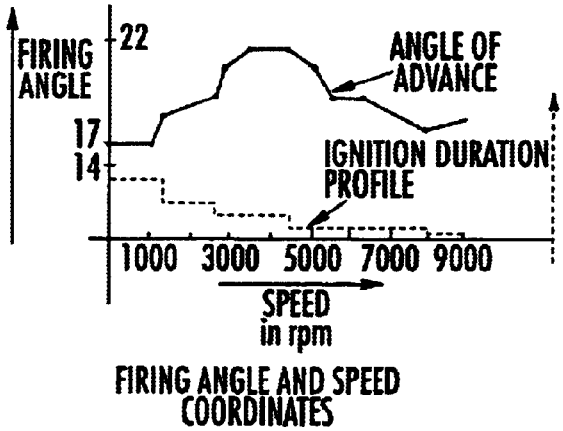
FIG. 3*a* is a graph of a sample triggering profile for the system of FIG. 2.

A sample ignition profile is illustratively shown in FIG. 3*a*. This profile is user defined. Only the points of inflexion (i.e., corner points) of the ignition profiles are stored. Other points are calculated along the straight line of the profile. Engine speed along with acceleration/deceleration, throttle position, and other operating conditions can be used to compute the actual angle of advance. It is also possible to store multiple such profiles, and one of these profiles can be selected dynamically depending on other factors like throttle position, etc. Throttle position can be sensed by a suitably mounted potentiometer. A DC—DC converter output voltage can also be sensed using an analog-to-digital converter associated with the microcontroller 2.7 for finer adjustments.

Figure 3B:
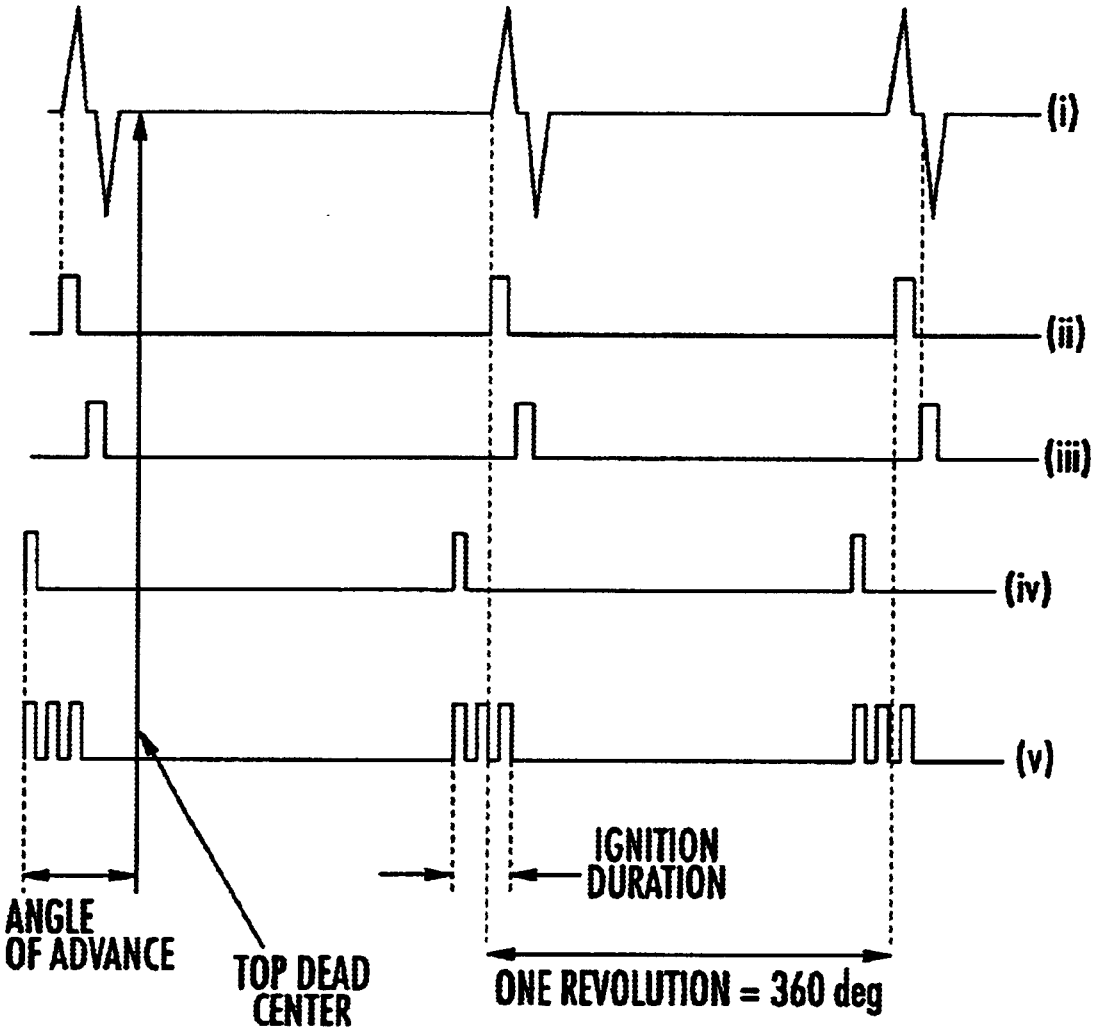
FIG. 3*b* is a timing diagram showing sample input and output waveforms for an ignition system for a single cylinder according to the present invention.

FIG. 3*b* illustrates the typical input/output signals from the microcontroller 2.7 for both conventional and extended spark operation of the CDI system of the instant invention in a single cylinder engine. The input signals from the speed/position sensor before and after signal conditioning are illustrated in (i), (ii) and (iii). More particularly, the signal illustrated in (i) represents the output of a variable reluctance speed/position sensor, and the corresponding pulses illustrated in (ii) and (iii) are obtained by conditioning both the positive and negative portions of the signal in (i), respectively, which may then be used by the microcontroller 2.7. Multiple output pulses for ignition of prolonged duration are illustrated in (v), while a single pulse output suitable for conventional CDI operation is shown in (iv). The firmware can generate both angle of advance or retardation to fulfill user defined ignition profile.

The ignition current can be made continuous for any ignition duration. The DC—DC converter should have sufficient power capability to supply the total energy required for the maximum ignition duration. The DC—DC converter can also be replaced by an engine-mounted alternator, which are typically already included with conventional systems. An ignition pulse from the microcontroller 2.7 is synchronized with the speed/position pulses using a programmable angle of advance (or retardation). Firmware is developed to ignore noise at speed/position sensing port.

Figure 4:
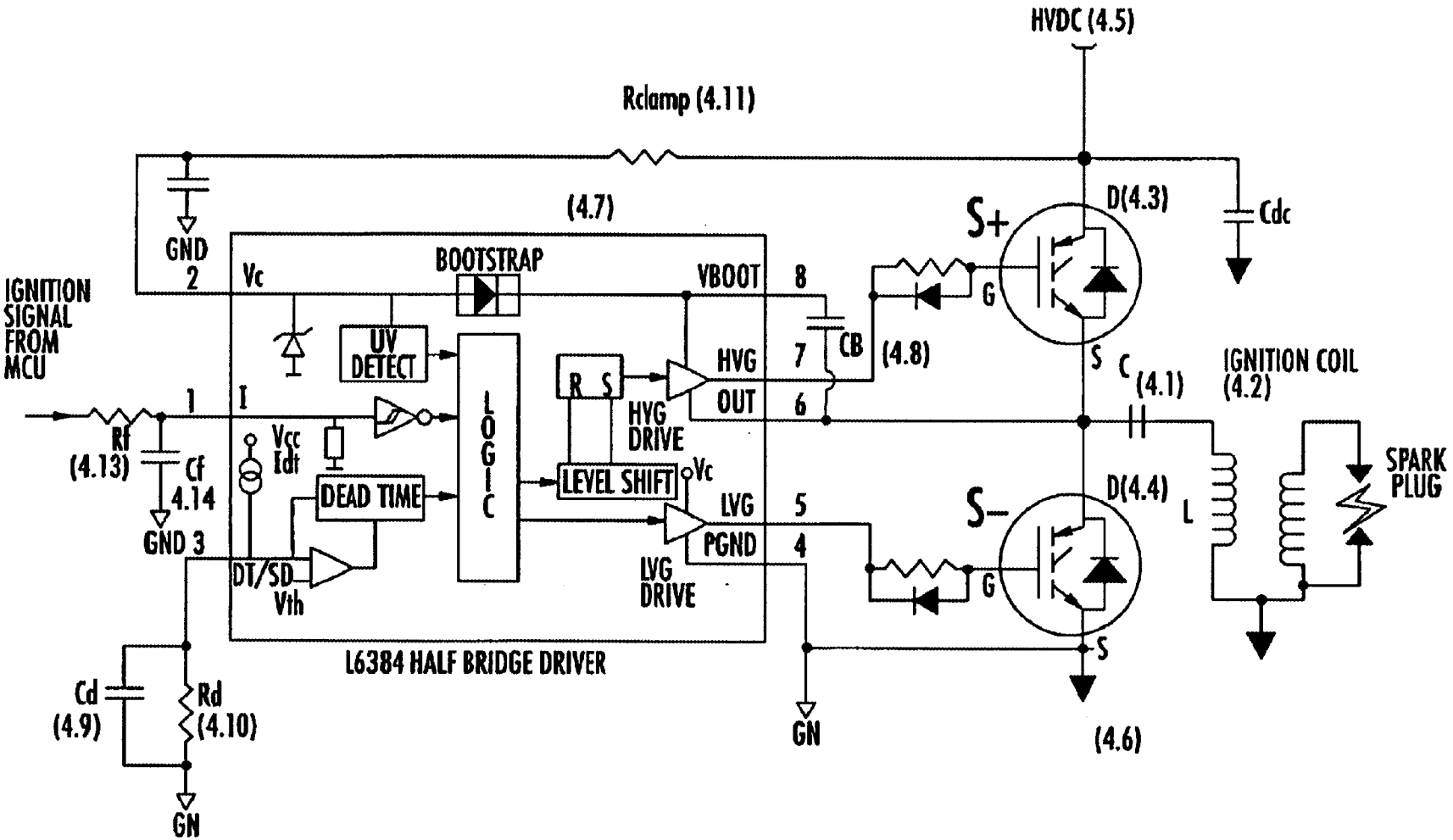
FIG. 4 is a schematic circuit diagram of a power converter according to the present invention.

The power converter topology in accordance with the present invention that is used for generating sparks of prolonged duration is now further descried with respect to FIG. 4. The ignition circuit includes an ignition capacitor 4.1 connected in series with the primary winding of ignition coil 4.2. The other terminal of the capacitor 4.1 is connected to the mid-point of a series combination of two controllable power electronic switches, namely switches 4.3 (S+) and 4.4 (S−) realized by two IGBTs. However, it will be appreciated that MOSFETs/BJTs may also be used, for example.

The collector (drain) of the top switch 4.3 (S+) is connected to the positive terminal of a DC—DC converter 4.5 (or rectified output from an engine-mounted permanent magnet alternator). The emitter (source) of the switch 4.4 (S−) is connected to the negative terminal 4.6 of the DC—DC converter, and the other terminal of the ignition coil is connected to a common ground. The control terminals of the switches are driven by a half-bridge driver 4.7 (such as an L6384 by STMicroelectronics, for example) that is controlled by a microcontroller programmed to provide alternative switching at a particular piston position depending on the speed of engine. The ignition duration is also programmed to be a function of engine speed.

Each of the power devices 4.3 (S+) and 4.4 (S−) turns ON if there is a proper voltage at its gate with respect to the emitter of the device. However, the voltage of the emitter of 4.3 (S+) is floating. The half-bridge driver has the capability to switch both top and bottom devices without any isolated supply. It derives its own power supply (Vcc) via an internal Zener diode and has a bootstrap arrangement for generating supply voltage for the floating HVG driver. The capacitors 4.8 ($C_B$), 4.9 ($C_d$), and resistor 4.10 ($R_d$) and 4.11 ($R_{clamp}$) are required for operation of the exemplary half bridge. Of course, different sets of components may be used if a different half bridge driver is used.

Ignition signal 4.12 is fed to pin3 (IN) of the half bridge driver 4.7 through a low pass filter including the combination of a resistor 4.13 (Rf) and capacitor 4.14 (Cf). The use of this filter is optional. The HVG driver output of an L6384 device is in phase with the input at the IN pin, while the LVG driver output is out of phase. An alternative switching of the devices, with a small dead time (e.g., 1–4 microseconds), causes damped oscillatory ignition current charging and discharging current in the ignition capacitor and primary ignition coil winding, which results in ignition current in the spark plug connected to the secondary ignition coil winding.

Figure 4A:
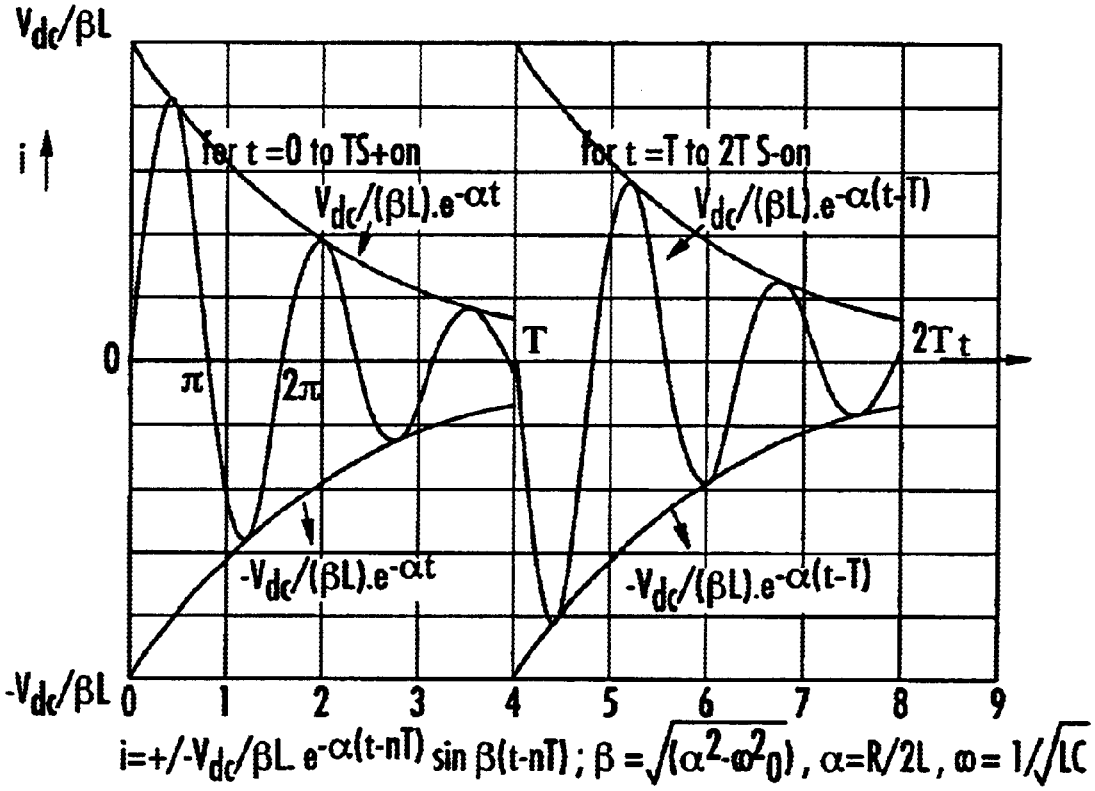
FIG. 4*a* is a graph of a sample ignition current profile for two consecutive cycles for the ignition system of the present invention.

The ignition current is illustratively shown in FIG. 4*a*. The current includes a series of damped sinusoids. The oscillatory current waveforms shown in FIG. 4*a* are repetitive and are caused by alternative charging and discharging of the ignition capacitor caused by the corresponding switching of the top and bottom IGBTs, as explained above with reference to FIG. 4*a*. Thus, unlike conventional prior art systems, the ignition capacitor advantageously need not be charged to start the ignition.

A train of such ignition current signals makes the spark extendable to any desired length of time. The present invention also facilitates production of multiple sparks with any desired delay between sparks. The peak current of the LC oscillation is determined by total circuit resistance, while the time period of oscillation is determined by Leq•C, where Leq is the equivalent inductance of the coil. The negative peak of the current is caused by the discharge of C through the bottom IGBT. Oscillations are damped out due to energy consumption of spark plug and the coil. Immediately after the discharge oscillation dies out, the top IGBT (S+) is turned on, which in turn causes a new oscillation that extends over the spark duration. The supply (e.g., DC—DC converter) should preferably be sufficient to start the new oscillation cycle.

The waveform illustrated in FIG. 4*a* shows that spark gap current flows practically for the whole duration. The air ionizes once the arc strikes, thus the air gap resistance falls and enables the current to oscillate even though the output voltage across the air gap falls. It will be observed that a new cycle of oscillation can also be started even before the previous oscillation has been damped out. For example, the discharge cycle can also be started at $t=\pi$ or $3\pi$, instead of $t=T(\phi 5\pi)$, to increase the r.m.s. value of the current wave form. This can also be used to fine-tune the total ignition duration.

The ignition duration can also be controlled by turning off the corresponding switch when an oscillation is in progress. However, this is preferably done at a zero crossing of the ignition current when the capacitor is totally charged or discharged. Conventional ignition coils typically do not have isolation between the primary and secondary windings. Yet, one particularly advantageous feature of the present invention is that such isolation is not required.

FIGS. 5(*a*)–5(*e*) illustrate equivalent circuits which may be used for a quantitative analysis. The ignition coil can be modeled as a step-up transformer, and the spark plug as a resistive load which switches on if the voltage is sufficiently large and remains on until the voltage across the air gap becomes steady at zero. The equivalent circuit of the spark plug and ignition coil is shown in FIG. 5(*a*). The resistor $r'_{arc}$ is the arc resistance associated with the primary winding of the coil. The approximate equivalent circuit of the ignition coil is shown in FIG. 5(*b*). Moreover, FIG. 5(*c*) shows the equivalent circuit for the circuit with the coil.

Figure 5A:
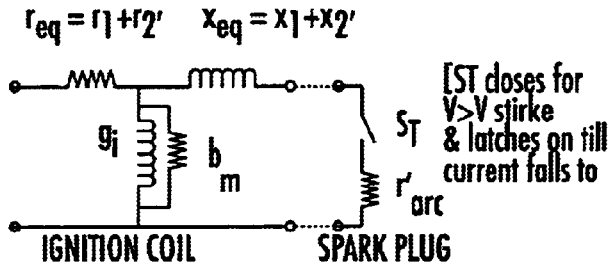
FIGS. 5*a* to 5*e* are schematic circuit diagrams illustrating equivalent circuits for various operational conditions in accordance with the present invention.
Figure 5B:
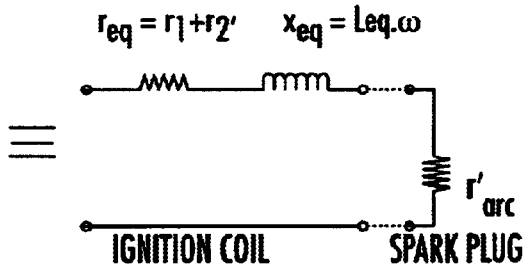
Figure 5C:
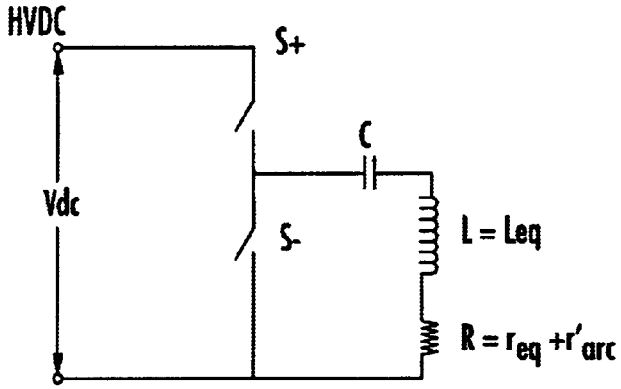
Figure 5D:
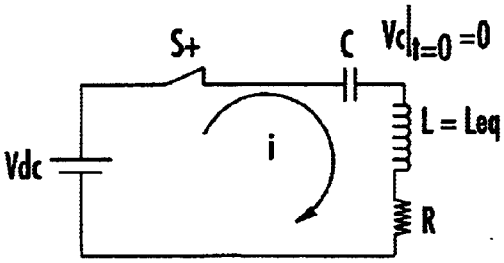
Figure 5E:
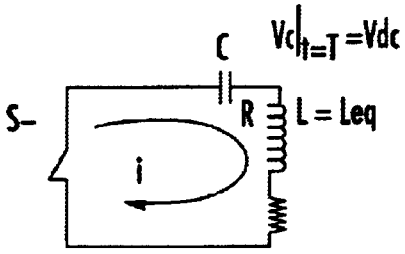

There are two cases of switching. The first is where the capacitor is not charged, i.e., Vc=0, and the top switch closes resulting in a charging current (FIG. 5(*d*)). The other case is where the capacitor is charged, i.e., Vc=Vdc, and the bottom switch closes which sets a discharging current (FIG. 5(*e*)). The mesh equations are thus:

$$Ri+Ldi/dt+1/c(\int idt)=Vdc \text{(FIG. 5(d))}; \text{ and}$$

$$Ri+Ldi/dt+1/c(\int idt)=0 \text{ (FIG. 5(e))}.$$

Differentiating the second equation and diving by L provides:

$$\frac{d^2i}{dt}+\left(\frac{R}{L}\right)\frac{di}{dt}+\frac{i}{LC}=0.$$

A solution to this equation is of the form $I=A1e^{s1t}+A2e^{s2t}$. Substituting this solution:

$$A1e^{s1t}(s1^2+Rs1/L+1/LC)+A2e^{s2t}(s2^2+Rs2/L+1/LC)=0,$$

$$\text{i.e. } S1=\frac{R}{2L}+\sqrt{\left(\frac{R}{2L}\right)^2-\frac{1}{LC}}=-\alpha+\beta,$$

$$\text{i.e. } S2=\frac{R}{2L}-\sqrt{\left(\frac{R}{2L}\right)^2-\frac{1}{LC}}=-\alpha-\beta,$$

where $\alpha=R/2L$ and $\beta=\sqrt{(\alpha^2-\omega_{0^2})}$ and $$\omega_0=\frac{1}{\sqrt{LC}}.$$

When $\alpha<\omega_0$, the system is under damped and produces oscillatory current for a stepped input, and s1 and s2 are complex conjugates, that is:

$$S1=\alpha+j\beta,\ s2=\alpha-j\beta \text{ and } \beta=\sqrt{w_{0^2-\alpha^2}}, \text{ or}$$

$$i(t)=e^{-\alpha t}(A1e^{j\beta t}+A2e^{-j\beta t})=e^{-\alpha t}(A3\cos\beta t+A4\sin\beta t)$$

for discharge (FIG. 1D.), where A1, A2, A3, A4 are constants. Moreover, I(0+)=0 and Vc(0+)=Vdc, which implies that A3=0. Further, L·di/dt=Vc(0+), →

$$A4=\pm\frac{Vdc}{\beta L}.$$

Thus, $$i=\pm\frac{Vdc}{\beta L}\cdot e^{-\alpha t}\sin\beta t,$$

or the general equation for multiple charge and discharge cycle is:

$$i=\pm\frac{Vdc}{\beta L}e^{-\alpha(t-nT)}\sin\beta(t-nT),$$

where T is the duration for which S+ or S− remains on and n=0,1,2 . . . . With respect to FIG. 5(*d*), 0<t<T, and with respect to FIG. 5(*e*), T<to<2T. The preceding equation can be used to determine the time each switch must be on to obtain desired ignition current profile. Since the stored energy in the coil is zero after a charge or discharge oscillation, the energy equation is thus:

$$\frac{1}{2}CV_{dc}^2=\int_{nT}^{(n+1)T}i^2(Req+R'_{arc})dt=\int_{nT}^{(n+1)T}i^2Req\cdot dt+\int_{nT}^{(n=1)T}i^2R'_{arc}dt.$$

The first term represents loss in the system, while the second term represents the energy available in the air gap.

Figure 6:
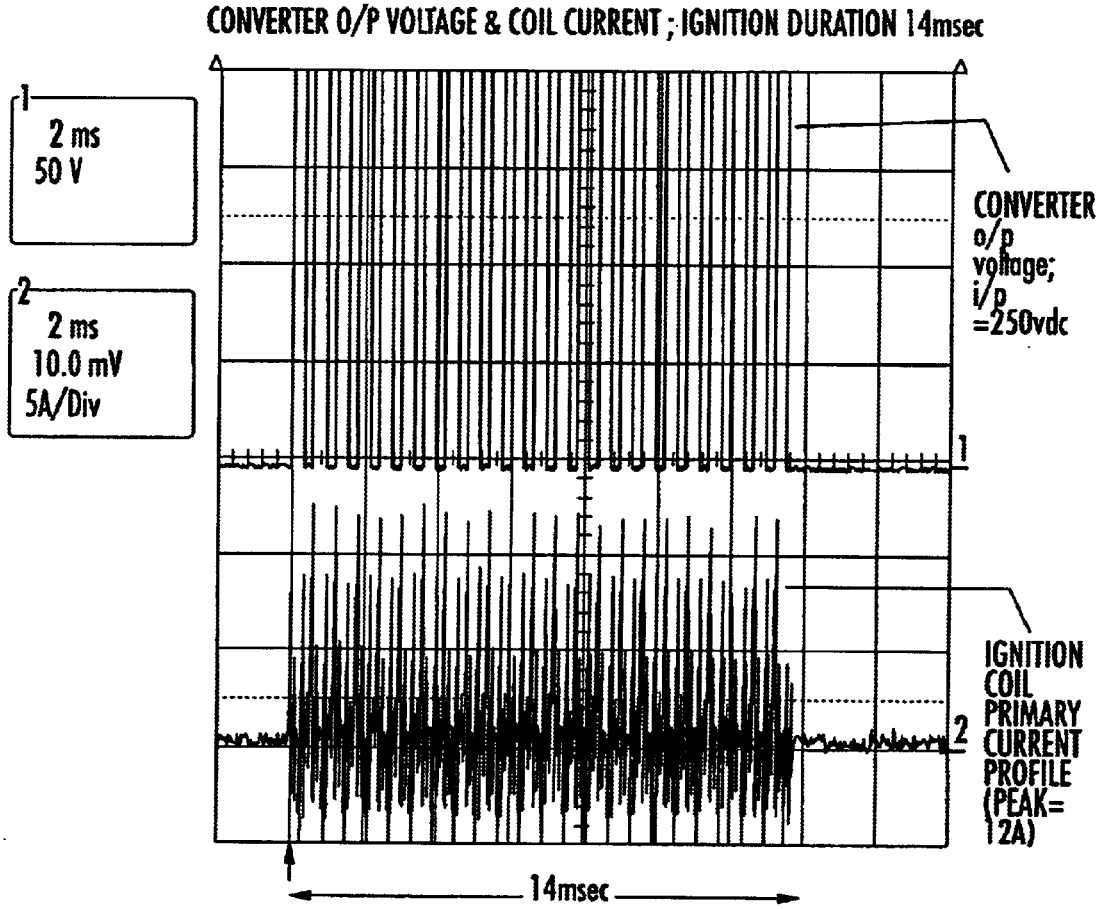
FIG. 6 is a graph including a set of waveforms for the improved CDI system according to the present invention.
Figure 6A:
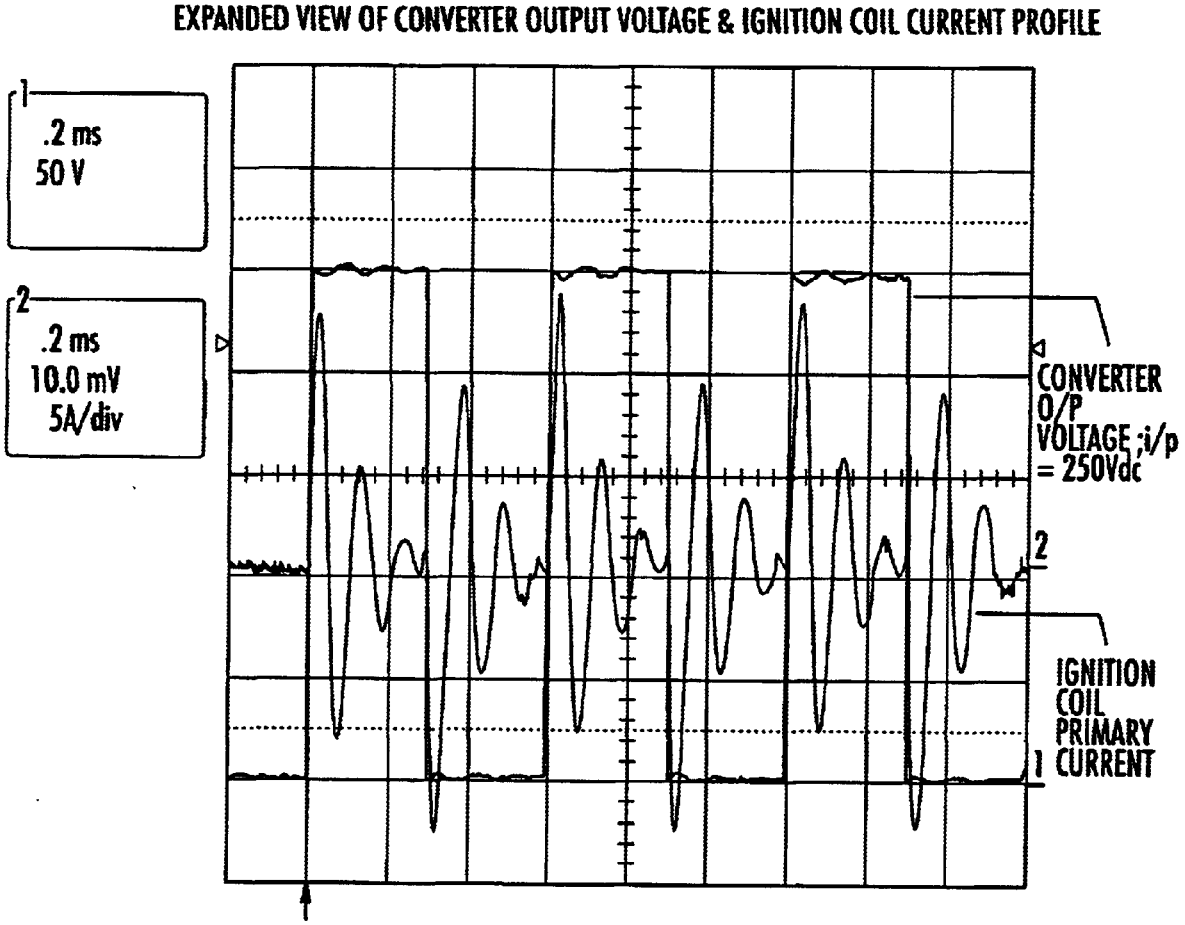
FIG. 6*a* is a graph of an expanded view of the converter output voltage and ignition coil current profile of FIG. 6.

Turning now to FIG. 6, the converter output and ignition current waveform determined experimentally for a duration of 14 ms are shown. This burst of ignition current is positioned at a predetermined angle of advance with respect to top dead center. An expanded view of the output voltage and current are shown in FIG. 6*a*. The waveforms show the ability of the system of the present invention to produce ignition current for prolonged durations. The ignition current is also similar to the primary current. It may be seen from FIG. 6*a* that the ignition current is continuous during the whole duration. That is, the new cycle of oscillation begins before the previous cycle dies down.

That which is claimed is:

1. A capacitor discharge ignition (CDI) system comprising:

an ignition coil comprising primary and secondary windings;

a spark plug having a spark gap connected across the secondary winding;

an ignition capacitor having first and second terminals, the first terminal being connected to the primary winding of the ignition coil;

a first controllable power switching circuit connected between the second terminal of the ignition capacitor and a voltage reference;

a high voltage DC source; and a second controllable power switching circuit connected between the high voltage DC source and the second terminal of said ignition capacitor; and a controller for cooperating with said first and second controllable power switching circuits to cause said first controllable power switching circuit to discharge said ignition capacitor and said second controllable power switching circuit to charge said ignition capacitor to provide an ignition current through said ignition coil for at least one charge and discharge cycle of said ignition capacitor.

2. The CDI system of claim 1 wherein said high voltage DC source comprises a DC—DC converter that provides a high DC voltage substantially independent of supply voltage variations.

3. The CDI system of claim 1 wherein said first and second controllable power switching circuits comprise at least one of insulated gate bipolar transistors (IGBTs), metal oxide semiconductor field-effect transistors (MOSFETs), and bipolar junction transistors (BJTs).

4. The CDI system of claim 1 wherein said controller comprises a microcontroller and a half bridge driver associated therewith for driving said first and second controllable power switching circuits.

5. The CDI system of claim 1 wherein said controller comprises a triggering control device for controlling ignition based upon an ignition profile.

6. The CDI system of claim 5 wherein said triggering control device comprises a data storage device for storing the ignition profile.

7. The CDI system of claim 5 wherein said ignition profile defines ignition occurrence and duration values with respect to piston positions and engine speeds.

8. The CDI system of claim 5 wherein said ignition profile provides increased ignition durations during cold starting and at reduced speeds.

9. The CDI system of claim 5 wherein said controller comprises a triggering control device for controlling ignition based upon signals corresponding to at least one of piston position, engine speed, throttle position, emission quality, and fuel type.

10. The CDI system of claim 9 wherein said triggering control device comprises a signal processor for conditioning the signals.

11. The CDI system of claim 9 wherein said high voltage DC source comprises an engine alternator.

12. A capacitor discharge ignition (CDI) system comprising:

an ignition coil comprising primary and secondary windings, said primary and secondary windings each having first and second terminals, and the second terminals of said primary and secondary windings being connected to a voltage reference;

an ignition capacitor having first and second terminals, the first terminal of said ignition capacitor being connected to the first terminal of said primary winding;

a first controllable power switching circuit having an input terminal, an output terminal, and a control terminal, the input terminal of said first controllable power switching circuit being connected to the second terminal of said ignition capacitor, and the output terminal of said first controllable power switching circuit being connected to the voltage reference;

a high voltage DC source;

a second controllable power switching circuit having an input terminal, an output terminal, and a control terminal, the input terminal of said second controllable power switching circuit being connected to said high voltage DC source, the output terminal of said second controllable power switching circuit being connected to the input terminal of said first controllable power switching circuit;

a controller having first and second outputs respectively connected to the control terminal of said first controllable power switching circuit and to the control terminal of said second controllable power switching circuit; and a spark plug having a spark gap connected across the first and second terminals of said secondary winding;

said first controllable power switching circuit for discharging said ignition capacitor and said second controllable power switching circuit for charging said ignition capacitor to provide an ignition current through said ignition coil for at least one charge and discharge cycle of said ignition capacitor.

13. The CDI system of claim 12 wherein said high voltage DC source comprises a DC—DC converter that provides a high DC voltage substantially independent of supply voltage variations.

14. The CDI system of claim 12 wherein said first and second controllable power switching circuits comprise electronic power switching devices.

15. The CDI system of claim 13 wherein said electronic power switching devices comprise at least one of insulated gate bipolar transistors (IGBTs), metal oxide semiconductor field-effect transistors (MOSFETs), and bipolar junction transistors (BJTs).

16. The CDI system of claim 12 wherein said controller comprises a microcontroller and a half bridge driver associated therewith for driving said first and second controllable power switching circuits.

17. The CDI system of claim 12 wherein said controller comprises a triggering control device for controlling ignition based upon an ignition profile.

18. The CDI system of claim 17 wherein said triggering control device comprises a data storage device for storing the ignition profile.

19. The CDI system of claim 17 wherein said ignition profile defines ignition occurrence and duration values with respect to piston positions and engine speeds.

20. The CDI system of claim 17 wherein said ignition profile provides increased ignition durations during cold starting and at reduced speeds.

21. The CDI system of claim 12 wherein said controller comprises a triggering control device for controlling ignition based upon signals corresponding to at least one of piston position, engine speed, throttle position, emission quality, and fuel type.

22. The CDI system of claim 21 wherein said triggering control device comprises a signal processor for conditioning the signals.

23. The CDI system of claim 12 wherein said high voltage DC source comprises an engine alternator.

24. A capacitor discharge ignition (CDI) system for use with an ignition coil comprising primary and secondary windings and a spark plug having a spark gap connected across the secondary winding, the CDI system comprising:

an ignition capacitor having first and second terminals, the first terminal being connected to the primary winding of the ignition coil;

a first controllable power switching circuit connected between the second terminal of the ignition capacitor and a first voltage reference;

a second controllable power switching circuit connected between a second voltage reference and the second terminal of said ignition capacitor; and a controller for cooperating with said first and second controllable power switching circuits to cause said first controllable power switching circuit to discharge said ignition capacitor and said second controllable power switching circuit to charge said ignition capacitor to provide an ignition current through said ignition coil for at least one charge and discharge cycle of said ignition capacitor.

25. The CDI system of claim 24 wherein said first and second controllable power switching circuits comprise at least one of insulated gate bipolar transistors (IGBTs), metal oxide semiconductor field-effect transistors (MOSFETs), and bipolar junction transistors (BJTs).

26. The CDI system of claim 24 wherein said controller comprises a microcontroller and a half bridge driver associated therewith for driving said first and second controllable power switching circuits.

27. The CDI system of claim 24 wherein said controller comprises a triggering control device for controlling ignition based upon an ignition profile.

28. The CDI system of claim 27 wherein said ignition profile defines ignition occurrence and duration values with respect to piston positions and engine speeds.

29. The CDI system of claim 27 wherein said ignition profile provides increased ignition durations during cold starting and at reduced speeds.

30. The CDI system of claim 24 wherein said controller comprises a triggering control device for controlling ignition based upon signals corresponding to at least one of piston position, engine speed, throttle position, emission quality, and fuel type.

31. The CDI system of claim 30 wherein said triggering control device comprises a signal processor for conditioning the signals.

32. The CDI system of claim 24 wherein the first voltage reference comprises ground and the second voltage reference comprises a high DC voltage.

33. A method for driving an ignition system comprising an ignition coil comprising primary and secondary windings, and a spark plug having a spark gap connected across the secondary winding, the method comprising:

connecting a first terminal of an ignition capacitor to the primary winding;

connecting a first controllable power switching circuit between a second terminal of the ignition capacitor and a first voltage reference;

connecting a second controllable power switching circuit between a second voltage reference and the second terminal of the ignition capacitor; and controlling the first and second controllable power switching circuits to cause the first controllable power switching circuit to discharge the ignition capacitor and the second controllable power switching circuit to charge the ignition capacitor to provide an ignition current through the ignition coil for at least one charge and discharge cycle of the ignition capacitor.

34. The method of claim 33 wherein the first and second controllable power switching circuits comprise at least one of insulated gate bipolar transistors (IGBTs), metal oxide semiconductor field-effect transistors (MOSFETs), and bipolar junction transistors (BJTs).

35. The method of claim 33 wherein controlling comprises controlling the first and second controllable power switching circuits based upon an ignition profile.

36. The method of claim 35 wherein the ignition profile defines ignition occurrence and duration values with respect to piston positions and engine speeds.

37. The method of claim 35 wherein the ignition profile provides increased ignition durations during cold starting and at reduced speeds.

38. The method of claim 36 controlling comprises controlling the first and second controllable power switching circuits based upon signals corresponding to at least one of piston position, engine speed, throttle position, emission quality, and fuel type.

39. The method of claim 38 further comprising conditioning the signals prior to controlling.

* * * * *